United States Patent [19]

Kokkinos

[11] 4,274,343

[45] Jun. 23, 1981

[54] LOW LOAD COAL NOZZLE

[75] Inventor: Angelos Kokkinos, New Hartford, Conn.

[73] Assignee: Combustion Engineering, Inc., Windsor, Conn.

[21] Appl. No.: 29,606

[22] Filed: Apr. 13, 1979

[51] Int. Cl.[3] ..... F23K 3/02

[52] U.S. Cl. ..... 110/263; 110/106; 110/347

[58] Field of Search ..... 110/101 CF, 104 R, 106, 110/113, 114, 261-266, 232, 347, 348; 122/479 R; 239/391, 424, 565, 587

[56] References Cited

U.S. PATENT DOCUMENTS

| | | | |
|---|---|---|---|
| 1,949,277 | 2/1934 | Jackson | 110/263 |
| 1,957,965 | 5/1934 | Kennedy et al. | 110/263 X |
| 2,363,875 | 11/1944 | Kreisinger et al. | 110/263 X |
| 2,608,168 | 8/1952 | Jackson | 431/176 |
| 2,800,888 | 7/1957 | Miller et al. | 110/261 X |
| 2,895,435 | 7/1959 | Bogot et al. | 239/424 X |
| 4,157,889 | 6/1979 | Bonnel | 110/263 X |
| 4,173,189 | 11/1979 | Cooper | 110/263 X |

*Primary Examiner*—John Petrakes

*Attorney, Agent, or Firm*—William W. Habelt

[57] ABSTRACT

An improved fuel-air admission assembly having a plate disposed along the longitudinal axis of the coal delivery pipe. The leading edge of the plate is orientated across the inlet end of the coal delivery pipe so that the high coal concentration portion of the primary air-pulverized coal stream discharging along the outer radius of the main fuel pipe outlet elbow is separated from the low coal concentration portion of the primary air-pulverized coal stream discharging along the inner radius of the main fuel pipe outlet elbow. The trailing edge of the plate is orientated across the outlet end of the coal delivery pipe so that the high and low coal concentration streams are directed into the furnace through separate nozzles.

7 Claims, 4 Drawing Figures

LOW LOAD COAL NOZZLE

BACKGROUND OF THE INVENTION

The present invention relates to improving the low load operation of fuel burners for use in pulverized coal-fired furnaces and, more particularly, to improving low load operation of fuel-air admission assemblies for directing a pulverized fuel-air mixture into the furnace by what is known as the tangential method of firing.

In view of today's fluctuating electricity demand, typified by peak demand occurring during weekday daytime hours and minimum demand occurring at night and on the weekends, electric utilities have chosen to cycle many of their conventional coal-fired steam generator boilers by operating them at full load during peak demand hours and reducing them to low loads during periods of minimum demand.

As a consequence of this mode of operation, the electric utilities have used large quantities of natural gas or oil to furnish additional ignition energy during low load operation because the current generation from coal-fired steam generator furnaces require stabilization of the coal flames when operating at low loads. The required amount of auxiliary fuel fired for stabilization purposes is significant and, for example, to maintain a 500 megawatt coal-fired steam generator at 10 to 15 percent load during minimum demand periods could require the use of 11,000 gallons of oil per day.

One common method of firing coal in conventional coal-fired steam generator boilers is known as tangential firing. In this method, pulverized coal is introduced to the furnace in a primary air stream through burners, termed fuel-air admission assemblies, located in the corners of the furnace. The fuel-air streams discharged from these assemblies are aimed tangentially to an imaginary circle in the middle of the furnace. This creates a fireball which serves as a continuous source of ignition for the incoming coal. More specifically, a flame is established at one corner which in turn supplies the required ignition energy to stabilize the flame emanating from the corner downstream of and laterally adjacent to it. When load is reduced, the flames emanating from each corner become shorter and, as a consequence, a reduction in the amount of ignition energy available to the downstream corner occurs. As a result, auxiliary fuel such as oil or natural gas must be introduced in each corner adjacent to the pulverized coal-air stream to provide additional ignition energy thereby insuring that a flameout and resultant unit trip will not occur.

Another problem associated with operating a coal-fired burner at low loads results in the fact that the pulverizing mills typically operate with a relatively constant air flow over all load ranges. When furnace load is reduced, the amount of coal pulverized in the mills decrease proportionally while the amount of primary air used to convey the pulverized coal from the mills through the admission assemblies into the furnace remains fairly constant, thereby causing the fuel-air ratio to decrease. When the load on the furnace is reduced to the low levels desired during minimum demand periods, the fuel-air ratio has decreased to the point where the pulverized coal-primary air mixture has become too fuel lean for ignition to stabilize without significant supplemental ignition energy being made available.

One way in which the need for auxiliary fuel firing during low load operation on coal-fired boilers can be reduced is disclosed and claimed in a related application Ser. No. 29,605 of even date of McCartney entitled, "Low Load Coal Bucket". The McCartney invention, which addresses both of the aforementioned problems, provides an improved fuel-air admission assembly incorporating a split coal bucket which permits a pulverized coal-fired furnace to be operated at low loads without use of auxiliary fuel to provide stabilization.

In accordance with the McCartney invention, the split coal bucket comprises an upper and a lower coal nozzle pivotally mounted to the coal delivery pipe, the upper and lower coal nozzles being independently tiltable. When the furnace is operating at low loads such as during the minimum demand periods, the primary air and pulverized coal stream discharging from the coal delivery pipe to split into an upper and a lower coal-air stream and independently directed into the furnace by tilting the upper coal nozzle upward and the lower coal nozzle downward. In doing so, an ignition stabilizing pocket is established in the locally low pressure zone created between the spread apart coal-air streams. Hot combustion products are drawn, i.e., recirculated into this low pressure zone thus providing enough additional ignition energy to the incoming fuel to stabilize the flame.

Ignition stability is further improved by the fact that as the upper and lower coal-air streams split, the coal in the upper coal-air stream tends to concentrate along the lower surface of the upper coal-air stream as a result of the density differential between the coal and air and the centrifugal forces generated as the upper coal-air stream is turned upward. Similarly, the coal in the lower coal-air stream tends to concentrate along the upper surface of the lower coal-air stream as the lower coal-air stream turns downward when passing through the lower coal nozzle. Since the lower surface of the upper coal-air stream and the upper surface of the lower coal-air stream border upon the ignition stabilizing zone established therebetween, the concentrated coal will be drawn into the ignition stabilizing zone thereby increasing the local fuel-air ratio above the fuel-air ratio present in the primary air and pulverized coal mixture leaving the pulverizer at low loads which, as explained above, is too fuel lean for ignition to stabilize without significant supplemental ignition energy being made available. By increasing the local fuel-air ratio in the low pressure ignition zone established between the spread apart coal-air streams, the need for supplemental energy for stabilizing ignition is reduced.

The present invention is an improvement upon the above-described McCartney invention and is directed at further increasing the local fuel-air ratio in the low pressure ignition zone established between the spread apart coal-air streams, thereby further reducing the need for supplemental energy for stabilizing ignition of the coal flame during low load operation.

SUMMARY OF THE INVENTION

The present invention provides an improved fuel-air adminsion assembly of the type incorporating a split coal bucket having an upper and a lower coal nozzle pivotally mounted to the coal delivery pipe and independently tiltable of each other, wherein the improvement comprises means disposed within the coal delivery pipe for separating the pulverized coal-primary air mixture received from the main fuel pipe outlet elbow into a first portion and a second portion, the first portion having a higher coal-air ratio than the second portion, and for maintaining said separation between the first and second portions for the length of the coal delivery pipe so that the first portion is directed into the furnace through the upper coal nozzle and the second portion is directed into the furnace through the lower coal nozzle.

As the primary air and pulverized coal mixture is being conveyed from the pulverizers through the main fuel pipe to the furnace, the mixture turns through an angle generally of 90° as it flows from the main fuel pipe through the main fuel pipe outlet elbow into the coal delivery pipe of fuel-air admission assembly. As the mixture turns through the main fuel pipe outlet elbow, the pulverized coal particles being denser than air tend to concentrate along the outer radius of the main fuel pipe outlet elbow due to centrifugal forces. Therefore, two distinct regions of differing fuel-air ratio are established within the primary air and pulverized coal mixture as it travels through the main fuel pipe outlet elbow. A first portion of the primary air-pulverized coal stream along the outer radius of the main fuel pipe outlet elbow has a high concentration of coal because of the more dense coal particles being displaced radially outward due to centrifugal forces as the primary air-pullverized coal stream turns through the main fuel pipe outlet elbow. A second portion along the inner radius of the main fuel pipe outlet elbow conversely has a low coal concentration.

In accordance with the invention, a plate is disposed along the longitudinal axis of the coal delivery pipe with its leading edge orientated across the inlet end of the coal delivery pipe so that that portion of the primary air-pulverized coal stream having a high coal concentration enters the coal delivery pipe on one side of the plate and that portion of the primary air-pulverized coal stream having a low coal concentration enters the coal delivery pipe on the other side of the plate. The trailing edge of the plate is orientated across the outlet end of the coal delivery pipe such that that portion of the primary air-pulverized coal stream having a high coal concentration is discharged from the coal delivery pipe through the upper coal nozzle and such that that portion of the primary air-pulverized coal stream having a low coal concentration is discharged from the coal delivery pipe through the lower coal nozzle.

As the upper coal-air stream is turned upward through the upper coal nozzle, the coal in this already high coal concentration stream tends to further concentrate along the lower surface of the upper coal nozzle because of the density differential between the coal particles and the air resulting in the coal particles being thrown outward by the centrifugal force as the coal-air stream turns upward through the upper coal-air nozzle. Thus, the coal is further concentrated along the lower surface of the coal-air nozzle and consequently is drawn into the low pressure ignition zone to form a subregion therein which has a fuel-air ratio significantly higher than that normally present at low load. This subregion because of its relatively high fuel-air ratio readily ignites thereby providing for the stable ignition of the remainder of the primary air-pulverized coal stream.

DESCRIPTION OF THE PREFERRED EMBODIMENT

Figure 1:
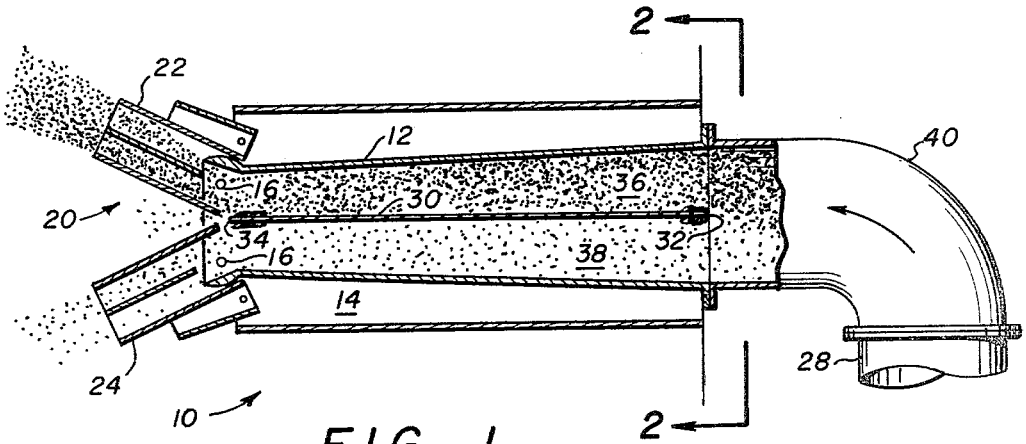
FIG. 1 is an elevational cross-sectional view of a fuel-air admission assembly with a plate disposed along the longitudinal axis of the coal delivery pipe in accordance with the present invention.

The figures show a fuel-air admission assembly 10 comprising a coal delivery pipe 12 extending therethrough and opening into the furnace, and a secondary air conduit 14 which surrounds the coal delivery pipe 12 and provides a flow passage so that the secondary air may be introduced into the furnace as a stream surrounding the primary air-pulverized coal stream discharging from the coal delivery pipe 12. In accordance with the McCartney invention, a split coal bucket 20 is disposed at the outlet end of the coal delivery pipe 12. The split coal bucket 20 comprises an upper coal nozzle 22 and a lower coal nozzle 24, each of which are pivotally mounted to the outlet end of the coal delivery pipe 12 and are independently tiltable about an axis 16 transverse to the longitudinal axis of the coal delivery pipe 12 so that a first and a second portion of the primary air and pulverized coal mixture discharging from the coal delivery pipe 12 may be selectively directed into the furnace in alignment with each other effectively forming a single coal-air stream, or as two diverging coal-air streams with at least one of the streams being discharged at an angle to the longitudinal axis of the coal delivery pipe 12.

The coal delivery pipe 12 receives at its inlet end a mixture of primary air and pulverized coal from a source, not shown, such as a pulverizer. In operation, coal is dried and crushed in the pulverizer, and the pulverized coal is conveyed from the pulverizer to the furnace through a main fuel pipe 28 which terminates in a main fuel outlet pipe elbow 40 aligned with the inlet end of the coal delivery pipe 12. As the primary air and pulverized coal mixture is being conveyed from the pulverizers through the main fuel pipe to the furnace, the mixture turns to an angle, generally but not necessarily of 90°, as it flows from the main fuel pipe through the main fuel pipe outlet elbow 40 into the inlet end of the coal delivery pipe 12 of the fuel-air admission assembly 10.

As the mixture turns through the main fuel pipe outlet elbow 40, the pulverized coal particles being denser than air tend to concentrate along the outer radius of the main fuel pipe outlet elbow 40 due to centrifugal forces. Therefore, two distinct regions of differing fuel-air ratio are established within the primary air-pulverized coal stream as it travels through the main fuel pipe outlet elbow 40. A first portion of the primary air-pulverized coal stream, traveling along the outer radius of the main fuel pipe outlet elbow 40, has a high concentration of coal because of the more dense coal particles being displaced radially outward due to centrifugal forces as the primary air-pulverized coal stream turns through the main fuel pipe outlet elbow 40. A second portion, traveling along the inner radius of the main fuel pipe outlet elbow 40, conversely has a low coal concentration.

In accordance with the invention, a partition plate 30 is disposed along the longitudinal axis of the coal delivery pipe 12 so as to establish an upper flow pathway 36 and a lower flow pathway 38 therethrough. The leading edge 32 of the partition plate 30 is orientated across the inlet end of the coal delivery pipe 12 so that the first portion of the primary air-pulverized coal stream traveling along the outer radius of the main fuel pipe outlet elbow 40 enters the upper flow pathway 36 of the main coal delivery pipe 12; and the second portion of the primary air-pulverized coal stream traveling along the inner radius of the main fuel pipe outlet elbow 40 enters the lower flow pathway 38 of the coal delivery pipe 12. In the preferred embodiment, the trailing edge 34 of the partition plate 30 is orientated across the outlet end of the coal delivery pipe 12 such that the upper flow pathway 36 communicates with the upper coal nozzle 22 and the lower flow pathway 38 communicates with the lower coal nozzle 24 so that the first portion of the primary air-pulverized coal stream, having a high coal concentration, is discharged from the coal delivery pipe 12 through the upper coal nozzle 22, and the second portion of the primary air-pulverized coal mixture, having a low coal concentration, is discharged from the coal delivery pipe 12 through the lower coal nozzle 24.

Figure 3:
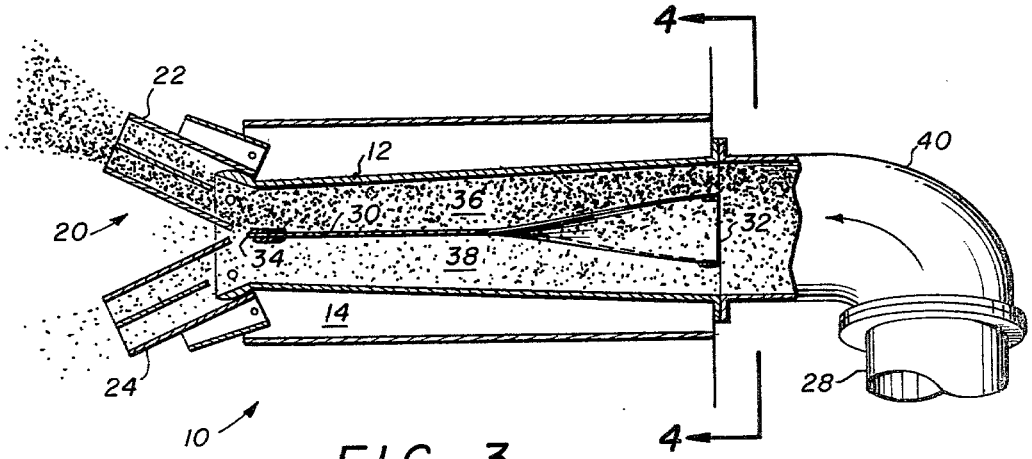
FIG. 3 is an elevational cross-sectional view of a fuel-air admission assembly with a twisted plate disposed along its longitudinal axis in accordance with the present invention.

Accordingly, the partition plate 30 separates the primary air-pulverized coal stream received from the main fuel pipe outlet elbow 40 into a first portion and a second portion, the first portion having a higher coal-air ratio than the second portion, and maintains the separation between the first and second portions for the length of the coal delivery pipe 12 so that the first portion is directed into the furnace through the upper coal nozzle 22 and the second portion is directed into the furnace through the lower coal nozzle 24 as shown in FIGS. 1 and 3.

Figure 2:
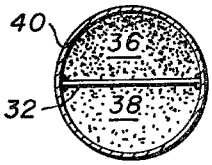
FIG. 2 is an end view taken along line 2—2 of FIG. 1.

In the embodiment illustrated in FIGS. 1 and 2, the main fuel pipe 28 travels vertically upward along the furnace and terminates in the main fuel pipe outlet elbow 40 which turns the primary air-pulverized coal stream from the vertical to the horizontal through a 90° angle. Accordingly, the pulverized coal is naturally concentrated in the upper half of the primary air-pulverized coal stream entering the coal delivery pipe 12. In this case, the partition plate 30 comprises a simple flat plate disposed along the longitudinal axis of the coal delivery pipe 12 since the concentrated pulverized coal stream may not be turned as it passes through the coal delivery pipe 12 in order to direct it through the upper coal nozzle 22.

Figure 4:
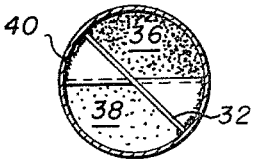
FIG. 4 is an end view taken along line 4—4 of FIG. 3.

In order to accommodate approaches of the main fuel pipe which are not directly upward, the partition plate 30 comprises a warped plate. As illustrated in FIGS. 3 and 4, the main fuel pipe 28 travels upward along the furnace and terminates in the main fuel pipe outlet elbow 40 which turns the primary air-pulverized coal mixture through a 90° angle to the horizontal but in a plane orientated at an angle to the vertical. The pulverized coal is concentrated along the outer half of the main fuel pipe outlet elbow 40 which, in this case, is not coincident with the upper half of the coal delivery pipe 12. Thus, the partition plate 30 is warped so that its leading edge 32 is orientated across the inlet end of the coal delivery pipe 12 such that the high coal concentration portion of the primary air-pulverized coal stream is directed along the upper flow pathway 36 to the upper coal nozzle 22 and the low coal concentration portion of the primary air-pulverized coal stream is directed along the lower flow pathway 38 to the lower coal nozzle 20.

In either embodiment, as the upper coal-air stream is turned upward through the upper coal nozzle, the coal in this already high coal concentration stream tends to further concentrate along the lower surface of the upper coal nozzle 22 because of the density differential between the coal particles and the air resulting in the coal particles being thrown outward by the centrifugal forces. The coal, being concentrated along the lower surface of the coal-air stream, is consequently drawn into the low pressure ignition zone to form a subregion therein which has a fuel-air ratio significantly higher than that normally present at low loads. This subregion because of its relatively high fuel-air ratio readily ignites thereby providing for the stable ignition of the remainder of the primary air-pulverized coal stream.

What is claimed is:

1. In a pulverized coal-fired steam generator having a furnace, a pulverizer for pulverizing coal, a main fuel pipe for conveying a mixture of primary air and pulverized coal from the pulverizer to the furnace, and a main fuel pipe outlet elbow disposed at the outlet end of the main fuel pipe; an improved fuel-air admission assembly having a coal delivery pipe having an inlet end for receiving the coal-air mixture from the main fuel pipe outlet elbow and an outlet end for discharging the coal-air mixture into the furnace, a first coal nozzle pivotally mounted to the outlet end of said coal delivery pipe so as to tilt about an axis transverse to the longitudinal axis of said coal delivery pipe, and a second coal nozzle pivotally mounted to the outlet end of said coal delivery pipe so as to tilt about an axis transverse to the longitudinal axis of said coal delivery pipe; wherein the improvement comprises:

means disposed within said coal delivery pipe for separating the coal-air mixture received from the main fuel pipe outlet elbow into a higher coal-air ratio portion and a lower coal-air ratio portion, and maintaining the separation between the higher and lower coal-air ratio portions for a substantial portion of the length of said coal delivery pipe so that the higher coal-air ratio portion is directed into the furnace through said first coal nozzle and the lower coal-air ratio portion is directed into the furnace through said second coal nozzle.

2. An improved apparatus as recited in claim 1 wherein said separating means comprises:

a partition plate disposed along the longitudinal axis of said coal delivery pipe so as to establish a first and second flow pathway therethrough, said partition plate having a leading edge orientated across the inlet end of said coal delivery pipe and a trailing edge orientated across the outlet end of said coal delivery pipe such that the higher coal-air ratio portion of the coal-air mixture received from the main fuel pipe outlet elbow flows through the first flow pathway to discharge into the furnace through said first coal nozzle and the lower coal-air ratio portion of the coal-air ratio portion of the coal-air mixture received from the main fuel pipe outlet elbow flows through the second flow pathway to discharge into the furnace through said second coal nozzle.

3. In a pulverized coal-fired stream generator having a furnace, a pulverizer for pulverizing coal, a main fuel pipe for conveying a mixture of primary air and pulverized coal from the pulverizer to the furnace, and a main fuel pipe outlet elbow disposed at the outlet end of the main fuel pipe; an improved fuel-air admission assembly having a coal delivery pipe having an inlet end for receiving the coal-air mixture form the main fuel pipe outlet elbow and an outlet end for discharging the coal-air mixture into the furnace, an upper coal nozzle pivotally mounted to the upper half of the outlet end of said coal delivery pipe so as to tilt about an axis transverse to the longitudinal axis of said coal delivery pipe, and a lower coal nozzle pivotally mounted to the lower half of the outlet end of said coal delivery pipe so as to tilt about an axis transverse to the longitudinal axis of said coal delivery pipe; wherein the improvement comprises:

means disposed within said coal delivery pipe for separating the coal-air mixture received from the main fuel pipe outlet elbow into a higher coal-air ratio portion and a lower coal-air ratio portion, and maintaining the separation between the higher and lower coal-air ratio portions for a substantial portion of the length of said coal delivery pipe so that the higher coal-air ratio portion is directed into the furnace through said upper coal nozzle and the lower coal-air ratio portion is directed into the furnace through said lower cable nozzle.

4. An improved apparatus as recited in claim 3 wherein said separating means comprises:

a partition plate disposed along the longitudinal axis of said coal delivery pipe so as to establish an upper and a lower flow pathway therethrough, said partition plate having a leading edge orientated across the inlet end of said coal delivery and a trailing edge orientated across the outlet end of said coal delivery pipe such that the higher coal-air ratio portion of the coal-air mixture received from the main fuel pipe outlet elbow flows through the upper flow pathway to discharge into the furnace through said upper coal nozzle and the lower coal-air ratio portion of the coal-air mixture received from the main fuel pipe outlet elbow flows through the lower flow pathway to discharge into the furnace through said lower coal nozzle.

5. A method of operating a pulverized coal-fired furnace wherein a mixture of pulverized coal and primary air is discharged into the furnace as a higher coal-air ratio portion and a lower coal-air ratio portion comprising:

a. turning the pulverized coal and primary air mixture through an elbow so that the pulverized coal is concentrated by centrifugal forces along the outer radius of the elbow thereby forming a higher coal-air ratio portion and a lower coal-air ratio portion within the pulverized coal and primary air mixture;

b. directing said higher coal-air ratio portion into and through a first flow pathway extending from the elbow to the furnace, and directing said lower coal-air ratio portion into and through a second flow pathway extending from the elbow to the furnace, the first and second flow pathways forming separate pathways to the furnace, whereby the coal-air ratios obtained in turning the elbow are maintained until said higher and lower coal-air ratio portions are independently directed into the furnace.

6. A method of operating a pulverized coal-fired furnace as recited in claim 5 further comprising directing said higher coal-air ratio portion and said lower coal-air ratio portion into the furnace in angular relationship to each other when the furnace is operated at low furnace rating.

7. A method of operating a pulverized coal-fired furnace as recited in claim 6 further comprising directing said higher coal-air ratio portion and said lower coal-air ratio portion into the furnace in parallel relationship to each other when the furnace is operated at a higher furnace rating.

* * * * *